US007841029B1

(12) United States Patent
Williams

(10) Patent No.: US 7,841,029 B1
(45) Date of Patent: Nov. 30, 2010

(54) RESTROOM SANITATION APPARATUS

(76) Inventor: Tanya A. Williams, 1414 Stanley Ter., Hillside, NJ (US) 07205

( * ) Notice: Subject to any disclaimer, the term of this patent is extended or adjusted under 35 U.S.C. 154(b) by 987 days.

(21) Appl. No.: 11/624,278

(22) Filed: Jan. 18, 2007

(51) Int. Cl.
*A47K 17/00* (2006.01)

(52) U.S. Cl. ..... 4/661

(58) Field of Classification Search ..... 4/661, 4/255.01, 255.11; 206/349
See application file for complete search history.

(56) References Cited

U.S. PATENT DOCUMENTS 5,958,150 A 9/1999 Borger et al.
6,038,709 A 3/2000 Kent
6,241,091 B1 6/2001 Moore et al.
6,383,457 B1 5/2002 Brown
6,729,470 B2 5/2004 Watlington

*Primary Examiner*—Tuan N Nguyen
(74) *Attorney, Agent, or Firm*—Crossley Patent Law; Mark A. Crossley

(57) ABSTRACT

A restroom sanitation apparatus that can be used to store and sanitize a toilet plunger within a restroom. The apparatus has a cylindrical lid that is mounted on a round base after a toilet plunger is placed on top of the round base. Within the base is located a scent drawer that includes a volume of material with an incorporated scent, and furthermore, an electric-powered fan which continuously blows air over the volume of material in an effort to disperse the scent throughout the air within a bathroom. The apparatus further includes a hook to mount the toilet plunger once it is within the outer casing and also includes an electric-powered ultraviolet light that acts to kill germs and bacteria once the cylindrical lid has been placed into contact with the round base.

11 Claims, 7 Drawing Sheets

RESTROOM SANITATION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved restroom sanitation apparatus that can be used to store and sanitize a toilet plunger within a restroom.

DESCRIPTION OF THE PRIOR ART

U.S. Pat. No. 6,729,470, issued to Watlington, discloses a plunger holder for storage of a plunger for easy access.

U.S. Pat. No. 6,038,709, issued to Kent, discloses a toilet plunger holder and cover including a cylindrical base coextensive in height with the plunger elastomeric head and a cover for the base with a narrow tubular portion that covers and is coextensive in length with the plunger handle.

U.S. Pat. No. 6,241,091, issued to Moore et al., discloses a decorative container that receives and stores a plumbing plunger in a generally upright position.

U.S. Pat. No. 6,383,457, issued to Brown, discloses a toilet plunger sanitizing and storage container system that includes an innocuous looking, cylinder-shaped, fluid impermeable, main toilet plunger container scalable with a container sealing lid.

U.S. Pat. No. 5,958,150, issued to Borger et al., discloses a device for storing and cleaning a toilet plunger that includes an open-topped container and a lid having two lid-halves with each lid-half having an interior surface and an exterior surface.

SUMMARY OF THE INVENTION

The present invention concerns that of a new and improved restroom sanitation apparatus that can be used to store and sanitize a toilet plunger within a restroom. The apparatus has a cylindrical lid that is mounted on a round base after a toilet plunger is placed on top of the round base. Within the base is located a scent drawer that includes a volume of volume of material with an incorporated scent, and furthermore, an electric-powered fan which continuously blows air over the volume of material in an effort to disperse the scent throughout the air within a bathroom. The apparatus further includes a hook to mount the toilet plunger once it is within the outer casing and also includes an electric-powered ultraviolet light that acts to kill germs and bacteria once the cylindrical lid has been placed into contact with the round base.

There has thus been outlined, rather broadly, the more important features of a restroom sanitation apparatus that the detailed description thereof that follows may be better understood and in order that the present contribution to the art may be better appreciated. There are, of course, additional features of the restroom sanitation apparatus that will be described hereinafter and which will form the subject matter of the claims appended hereto.

In this respect, before explaining at least one embodiment of the restroom sanitation apparatus in detail, it is to be understood that the restroom sanitation apparatus is not limited in its application to the details of construction and to the arrangements of the components set forth in the following description or illustrated in the drawings. The restroom sanitation apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present restroom sanitation apparatus. It is important, therefore, that the claims be regarded as including such equivalent constructions insofar as they do not depart from the spirit and scope of the present invention.

It is therefore an object of the present invention to provide a restroom sanitation apparatus which has all of the advantages of the prior art and none of the disadvantages.

It is another object of the present invention to provide a restroom sanitation apparatus which may be easily and efficiently manufactured and marketed.

It is another object of the present invention to provide a restroom sanitation apparatus which is of durable and reliable construction.

It is yet another object of the present invention to provide a restroom sanitation apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
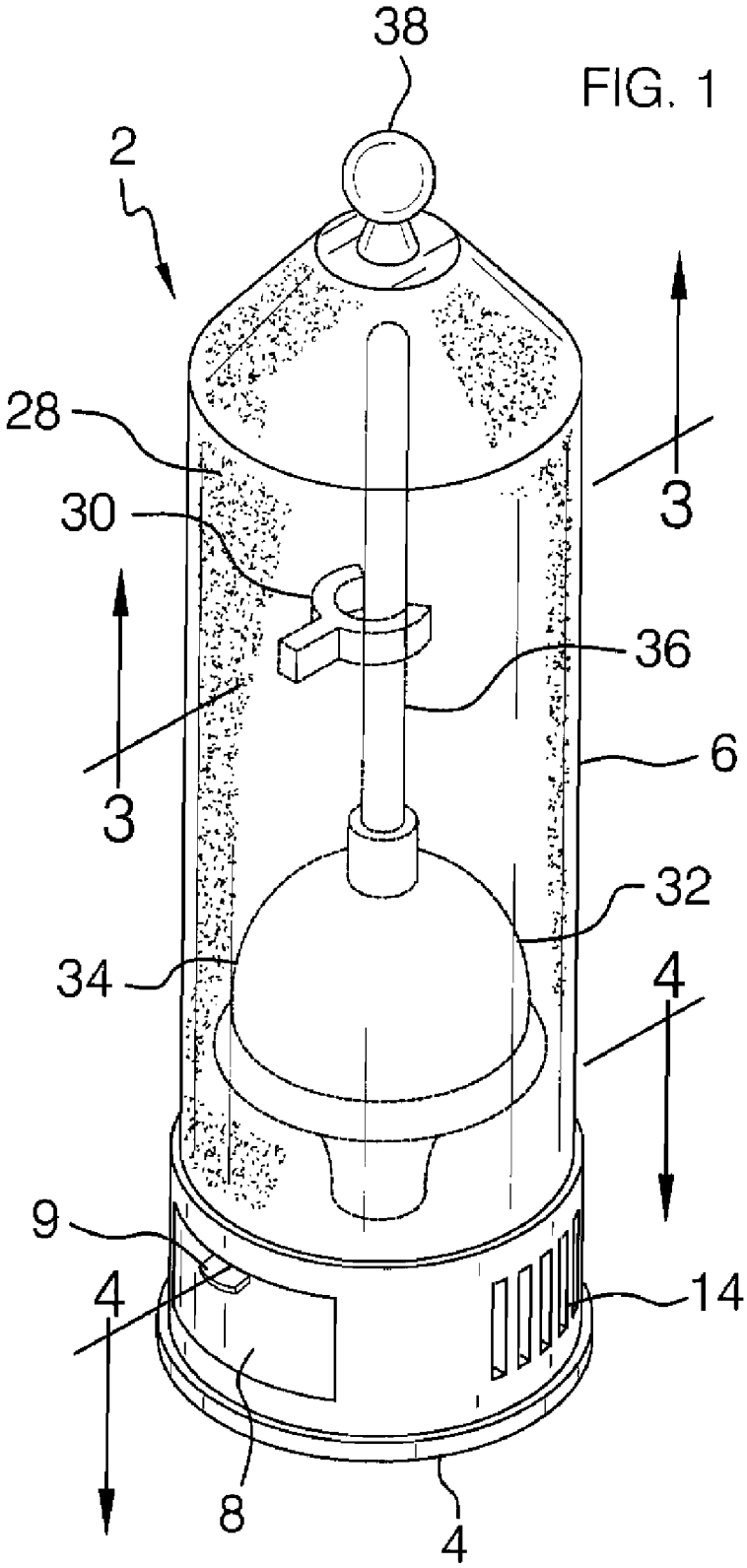
FIG. 1 shows a cutaway perspective view of the restroom sanitation apparatus as it would appear in use.
Figure 2:
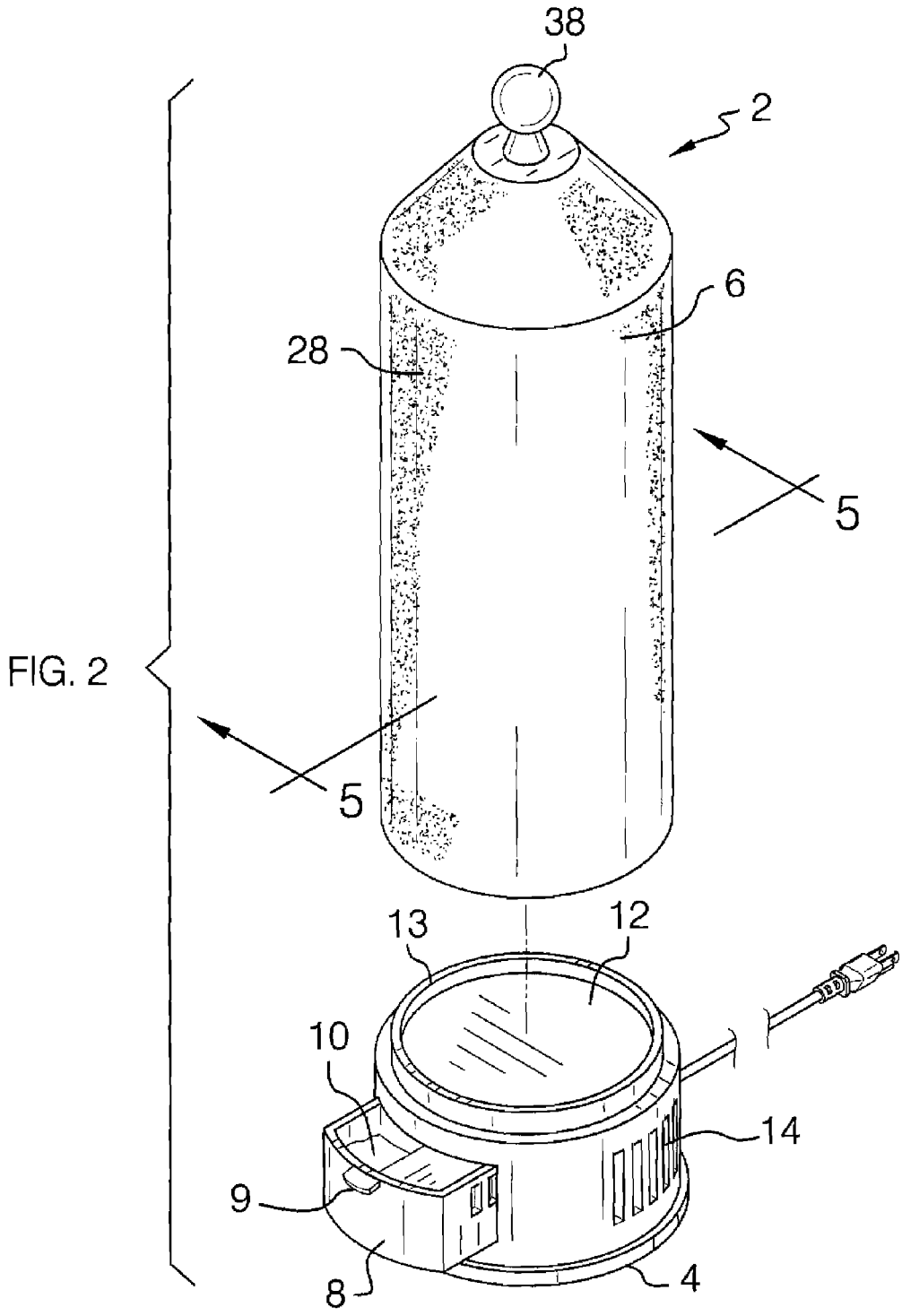
FIG. 2 shows a cutaway perspective view of the restroom sanitation apparatus as it would appear when the cylindrical lid is being placed onto the round base.
Figure 3:
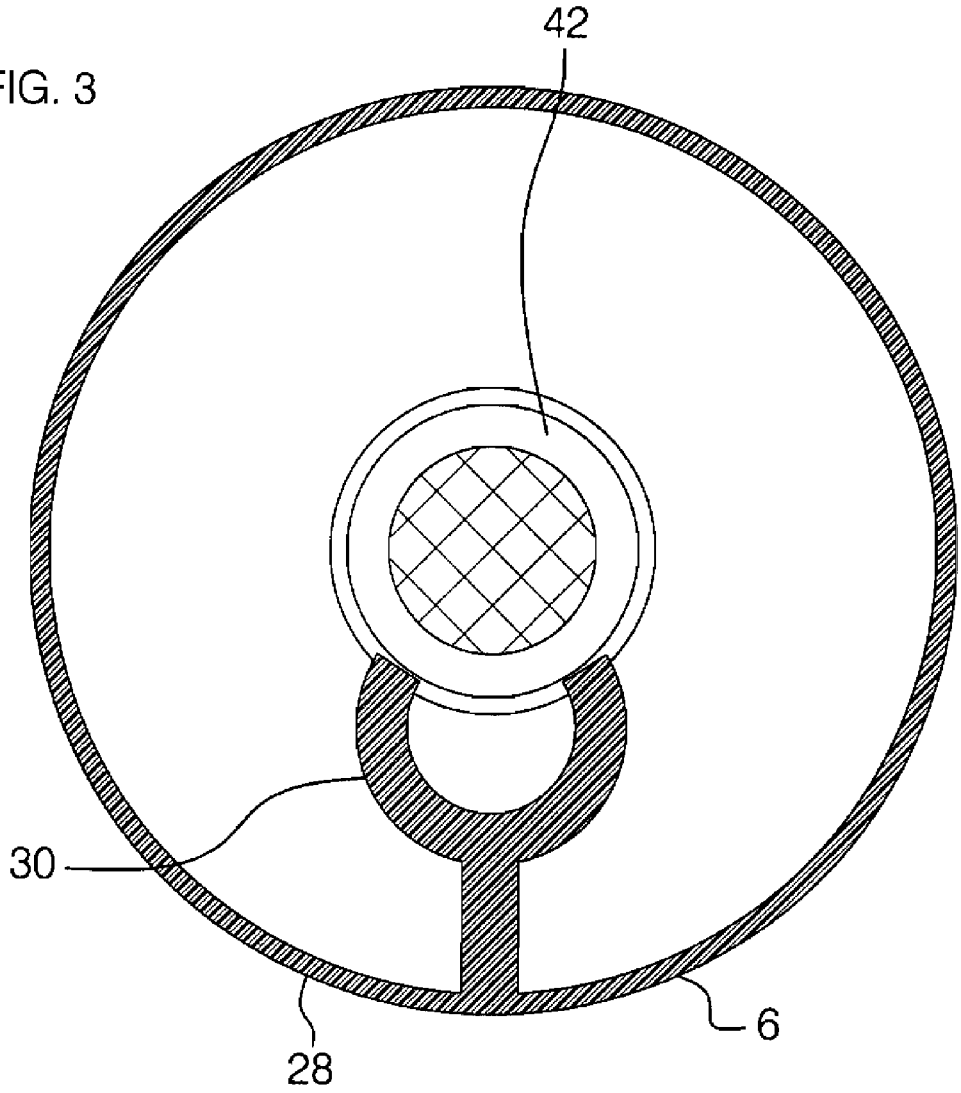
FIG. 3 shows a top cutaway view of the cylindrical lid of the restroom sanitation apparatus as it would appear in use.
Figure 4:
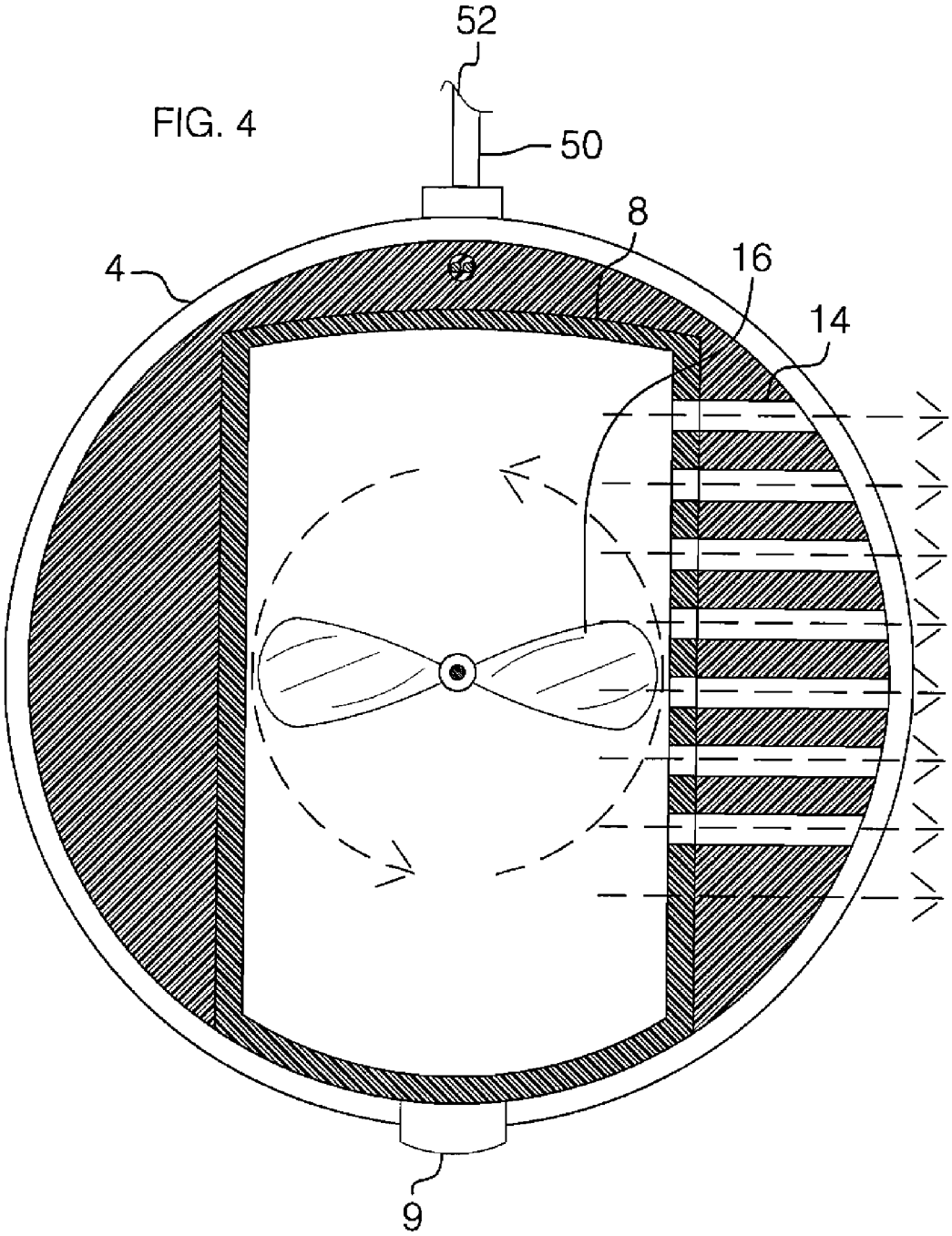
FIG. 4 shows a bottom cutaway view of the round base of the restroom sanitation apparatus as it would appear in use.
Figure 5:
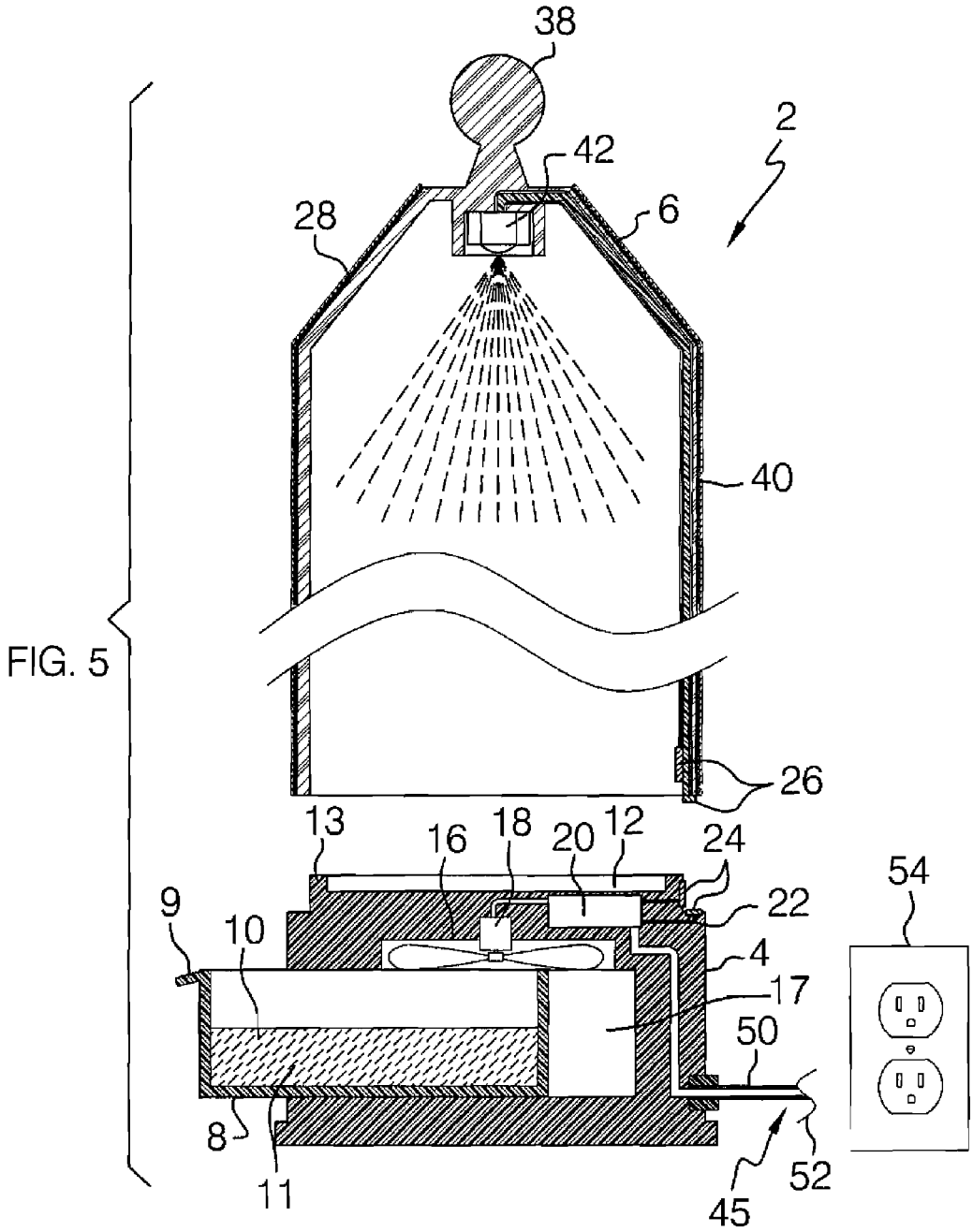
FIG. 5 shows a side cutaway view of the restroom sanitation apparatus as it would appear in use.
Figure 6:
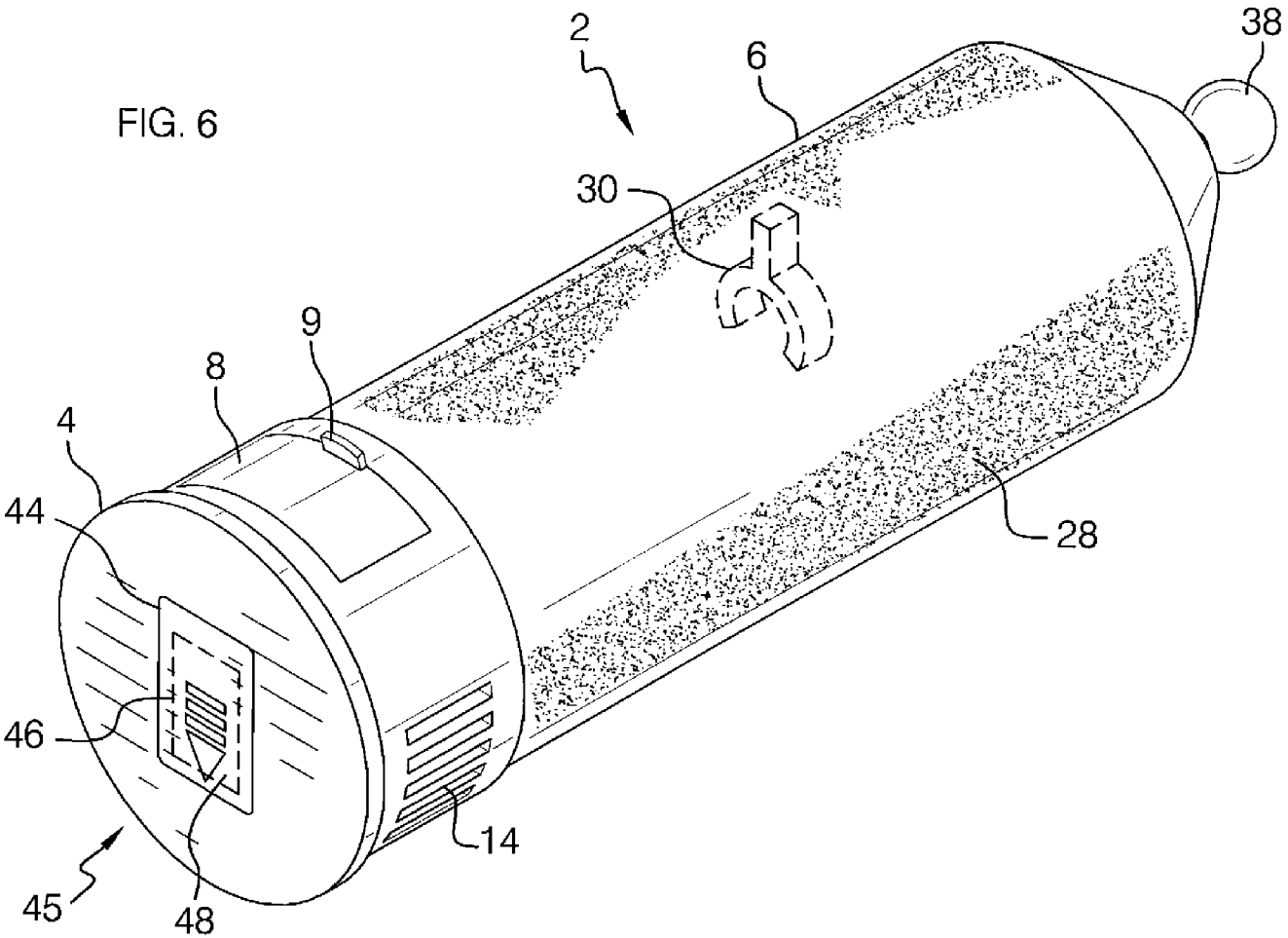
FIG. 6 shows a perspective view of an alternative embodiment of the restroom sanitation apparatus as it would appear in use.
Figure 7:
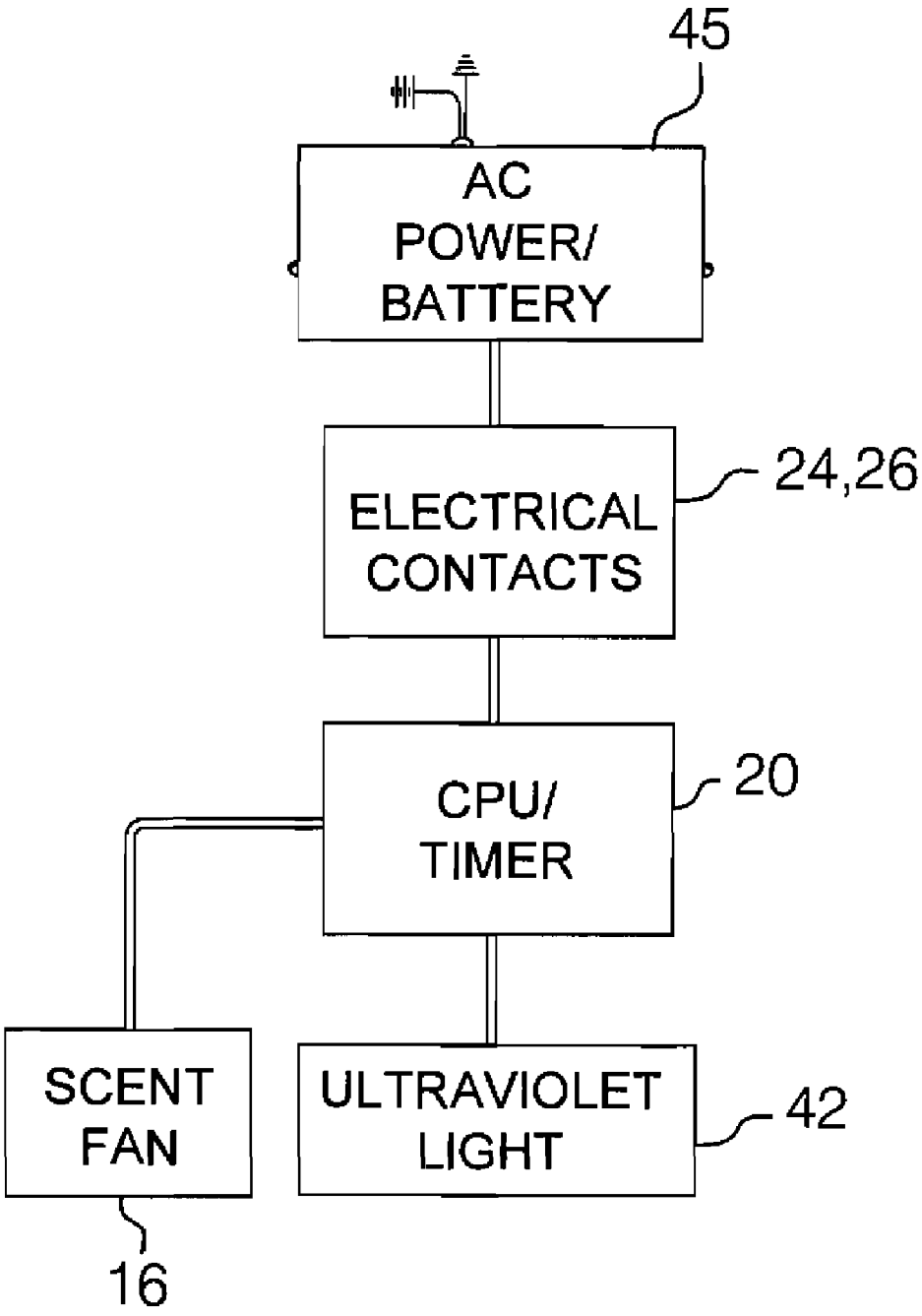
FIG. 7 shows a flowchart schematic of various components of the restroom sanitation apparatus and how they are interconnected with one another.

With reference now to the drawings, and in particular to FIGS. 1 through 7 thereof, a new restroom sanitation apparatus embodying the principles and concepts of the present invention and generally designated by the reference numeral 2 will be described.

As best illustrated in FIGS. 1 through 7, the restroom sanitation apparatus 2 comprises a base 4 that has two surfaces comprising a top surface and a bottom surface. The apparatus 2 further comprises a lid 6 that can be placed on top of the base 4. The base 4 itself preferably is cylindrical and would have a height between two to four inches.

The base 4 further comprises a scent drawer 8 that can be pulled out and pushed in via an attached handle 9. The scent drawer 8 includes a volume of material 10 that is either a liquid or gel so that the scent drawer 8 can be refilled easily as needed. The volume of material 10 incorporates an amount of scent 11 within it.

The top surface of the base 4 further comprises a basin 12 that allows for placement of objects on the base 4. The basin 12 has a small edge 13 that is located on the perimeter of the top surface of the base 4, allowing for containment of any liquid or objects that may be placed on the basin 12 on the to top surface of the base 4.

A fan 16 is axially mounted on a mount 18 within the base 4, with this fan 16 being located immediately over the top of the volume of scent 10 located within the scent drawer 8 when the scent drawer 8 is completely closed. The fan 16 is powered by power means 45, which preferably is a power cord 50 connected to the CPU 20, with the power cord 50 having a plug 52 that connects to a wall outlet 54 that has standard household current. In the alternative, the fan 16 can be powered by at least one battery 46 that is located within a battery compartment 44 that is accessible through a battery cover 48 located on the bottom surface of the base 4. The battery compartment 44 is attached to the CPU 20. The power means 45 is connected to wiring 22 located within the base 4, with this wiring 22 generally connected to a central CPU 20 located within the base 4. The CPU 20, in turn, is connected to the fan 16.

Immediately adjacent to the fan 16 within the base 4 is located an air chamber 17 and a plurality of vents 14. After the fan 16 blows for quite some time, some of the volume of scent 10 will evaporate into the air and enter the air chamber 17, at which time, it will evacuate the base 4 through the vents 14 located in the base 4, which are themselves located adjacent to the air chamber 17. Once the power means 45 stops producing power, however, the fan 16 will cease to function and it will not be able to assist in the dispersion of vapors from the volume of scent 10.

The lid 6 is designed to cover up a plunger 32 that can be placed within the apparatus 2. The plunger 32 comprises a head 34 and a handle 36, with the head 34 being placed flat on the basin 12 attached to the base 4. The handle sticks upright within the apparatus 2 under the lid 6 and is held in place by a hook 30 that is attached to the lid 6 within the lid 6. A decorative cover 28 can be placed over the lid 6 at the option of a user, but this is optional.

Within the lid 6 is located an ultraviolet light 42, with this light 42 being top-mounted and accessible through the removal of a knob 38 that is externally located on the lid 6. The light 42 shines downward on any object, in particular the plunger 32, that is located within the apparatus 2. Since ultraviolet light 42 is known to have a sanitary effect by killing bacteria and other organisms, having the ultraviolet light 42 on would definitely assist an individual in keeping the apparatus 2 sanitary.

The ultraviolet light 42 is powered by a length of wiring 40 that travels up the lid 6 on the outside of the lid 6. The wiring 40 is connected to the wiring 22 located on the base 4 through at least one lower electrical contact 24 and one upper electrical contact 26. The lower electrical contact 24 is located on the base 4 and is connected to the wiring 22. Furthermore, the upper electrical contact 26 is located on the lid 6 and is connected to the wiring 40. When the lid 6 is placed on the base 4 and the lower electrical contact 24 is placed into contact with the upper electrical contact 26, a circuit is created in between the power means 45 and the ultraviolet light 45, causing the light 42 to turn on.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. The restroom sanitation apparatus in combination with a plunger, the apparatus comprising:

a base having two surfaces comprising a top surface and a bottom surface, the base having a cylindrical shape, a lid placed on top of the base, means for having the base disperse a scent into the surrounding air, means for having the apparatus sanitize the plunger, wherein the means for having the base disperse a scent into the surrounding air further comprises:

a volume of material that includes a scent, means for storing the volume of material, a mount located within the base, a fan axially mounted to the mount, power means for providing power to the apparatus, means for connecting the power means to the fan, an air chamber located within the base, a plurality of vents located adjacent to the air chamber, wherein air being blown around by the fan causes the air to absorb a small amount of scent from the volume of material, further wherein the air will then enter the air chamber and exit the base through one or more vents.

2. The restroom sanitation apparatus in combination with a plunger according to claim 1 wherein the means for storing the volume of material further comprises (a) a scent drawer, the scent drawer capable of being pulled out of and pushed into the base, and (b) a handle attached to the scent drawer.

3. The restroom sanitation apparatus in combination with a plunger according to claim 2 wherein the means for connecting the power means to the fan further comprises (a) a first length of wiring, the first length of wiring being connected to the power means, and (b) a central processing unit, the central processing unit being connected to the first length of wiring, the central processing unit also being connected to the fan.

4. The restroom sanitation apparatus in combination with a plunger according to claim 3 wherein the apparatus further comprises (a) a basin located on the top surface of the base, (b) an edge surrounding the perimeter of the top surface of the basin, (c) wherein the plunger is placed on top of the basin when not in use.

5. The restroom sanitation apparatus in combination with a plunger according to claim 4 wherein the apparatus further comprises a hook, the hook being attached to the lid, the hook being located within the lid, wherein the plunger is set within the hook when the plunger is not in use.

6. The restroom sanitation apparatus in combination with a plunger according to claim 5 wherein the means for having the apparatus sanitize the plunger further comprises:

(a) at least one ultraviolet light, (b) a second length of wiring attached to the lid, the second length of wiring being attached to the ultraviolet light, (c) means for connected the second length of wiring to the first length of wiring.

7. The restroom sanitation apparatus in combination with a plunger according to claim 6 wherein the means for connected the second length of wiring to the first length of wiring further comprises:

(a) a lower electrical contact attached to the base, the lower electrical contact being connected to the first length of wiring, (b) an upper electrical contact located on the lid, the upper electrical contact being connected to the second length of wiring, (c) wherein placing the lid over the base such that the upper electrical contact is placed into contact with the lower electrical contact forces the two lengths of wiring to be indirectly connected.

8. The restroom sanitation apparatus in combination with a plunger according to claim 7 wherein the apparatus further comprises a handle, the handle being attached to the lid.

9. The restroom sanitation apparatus in combination with a plunger according to claim 8 wherein the handle further comprises a knob, the knob being attached to the lid.

10. The restroom sanitation apparatus in combination with a plunger according to claim 9 wherein the power means for providing power to the fan further comprises:

(a) a power cord attached to the central processing unit, (b) a wall outlet, the wall outlet containing access to standard household current, and (c) a plug connected to the power cord, the plug being insertable into the wall outlet.

11. The restroom sanitation apparatus in combination with a plunger according to claim 9 wherein the power means for providing power to the fan further comprises (a) a battery compartment located within the base, the battery compartment being attached to the central processing unit, (b) at least one battery located within the battery compartment, (c) a lid cover for covering the battery compartment when it is not in dust.

* * * * *